United States Patent [19]

Small

[11] 4,136,736

[45] Jan. 30, 1979

[54] BAFFLE

[75] Inventor: William M. Small, Bartlesville, Okla.

[73] Assignee: Phillips Petroleum Company, Bartlesville, Okla.

[21] Appl. No.: 715,704

[22] Filed: Aug. 20, 1976

Related U.S. Application Data

[63] Continuation-in-part of Ser. No. 681,670, Apr. 29, 1976, abandoned.

[51] Int. Cl.[2] ..... F28F 7/00

[52] U.S. Cl. ..... 165/162; 122/510

[58] Field of Search ..... 165/162, 172; 122/510

[56] References Cited

U.S. PATENT DOCUMENTS

| | | | |
|---|---|---|---|
| 2,018,037 | 10/1935 | Sieder | 165/162 X |
| 2,581,121 | 12/1947 | McCurdy, Jr. et al. | 165/162 X |
| 3,907,031 | 9/1975 | Tegethoff | 122/510 |
| 3,937,277 | 2/1976 | Krolman | 165/162 |
| 3,964,146 | 6/1976 | Vestre et al. | 165/162 |
| 3,967,677 | 7/1976 | Mohlman | 165/162 |

*Primary Examiner*—Charles J. Myhre
*Assistant Examiner*—Theophil W. Streule, Jr.

[57] ABSTRACT

A plurality of parallel tubes in the form of at least a first plurality of parallel tube rows and a second plurality of parallel tube rows are supported by a baffle comprising an outer ring capable of surrounding the tubes and a plurality of parallel rods which form a plurality of parallel chords with the outer ring wherein the rods are capable of passing in the spaces between the tubes forming adjacent parallel tube rows of one plurality of parallel tube rows and wherein the number of rods in the baffle is substantially less than the total number of rods which could be positioned in the spaces between the tube rows in the plurality of parallel tube rows.

23 Claims, 25 Drawing Figures

U IS THE OVERALL HEAT TRANSFER COEFICIENT.
TO CONVERT U IN $\frac{BTU}{(HR)(Ft^2)(°F)}$ TO
$\frac{WATTS}{(M^2)(°K)}$, MULTIPLY BY 5.678
TO CONVERT W IN $\frac{lb}{HR}$ TO $\frac{kg}{HR}$, MULTIPLY BY 0.4536

TO CONVERT $\frac{U}{\Delta P}$ IN $\frac{BTU}{(HR)(LB)(°F)}$ TO $\frac{WATTS}{(M^2)(°k)(Pa)}$, MULTIPLY BY 0.1186

TO CONVERT W IN $\frac{lb}{HR}$ TO $\frac{kg}{HR}$, MULTIPLY BY 0.4536

BAFFLE

This application is a continuation-in-part of my copending application Ser. No. 681,670, filed Apr. 29, 1976, now abandoned.

BACKGROUND OF THE INVENTION

The invention relates to a baffle and a method and apparatus for supporting a plurality of tubes. In another aspect the invention relates to heat exchangers such as shell and tube heat exchangers and to a method and apparatus to radially support the tubes in such heat exchangers.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed, the art of heat exchanger design is developed to a very high degree; however, there is still room for improvement in a number of areas, such as reducing pressure drop, increasing overall heat transfer coefficients, reducing fouling, and in heat exchangers utilizing a tube bundle, such as the shell and tube heat exchangers, improving tube support. In many instances the tubes in a shell and tube heat exchanger prematurely fail because the tubes vibrate or rub against one another or other parts of the heat exchanger, such as for example, a baffle or the shell.

The art has heretofore recognized the need for tube support.

Plate type baffles have been used in heat exchangers for many years. Such baffles provide support for the tubes at least to some degree. The double segmental plate-baffle heat exchanger is well known to those skilled in the art, and although heat exchangers using plate type baffles were a relatively early development in heat exchanger design, such exchangers are still widely used today. In most plate type baffle heat exchangers the passages in the plate baffles through which the tubes pass are slightly larger in diameter than the outside diameter of the tubes in order to facilitate construction of the exchanger, and as a result vibration of the tubes can and does occur which frequently results in premature tube failure.

U.S. Pat. No. 2,018,037, issued to Everett Norman Sieder on Oct. 22, 1935, describes a heat exchanger having a supported tube bundle in which a plurality of bars or rods is disposed in the lanes between tube rows. A bar or rod is disposed in each lane and affixed to a ring surrounding the tube bundle so that the bars form a series of parallel chords positioned in a plane perpendicular to the longitudinal axis of the tube bundle. When viewing a cross section of the longitudinal axis of the bundle as shown in FIGS. 2, 3 and 6 of the patent, a bar is shown in each and every lane. Thus, two groups or pluralities of bars provide radial support for each tube in the tube bundle. Although such a structure provides very good support for the tubes in the tube bundle, it incurs the penalty of a relatively large pressure loss which, besides being wasteful of energy, is usually a higher pressure loss than can be tolerated. In fact, even though this patented design is some thirty years old, it is not well accepted by industry as evidenced by the fact that it is rarely if ever used.

A tube support which is used and which does provide a low pressure drop is that described in U.S. Pat. No. 3,708,142, issued Jan. 2, 1973 to the same inventor as the inventor of the present invention. The design of the present invention provides a substantial improvement in heat transfer coefficients and fouling resistance at a relatively small increase in pressure drop as compared to the earlier invention referred to above. Thus, although the pressure drop is generally lower for an exchanger constructed in accordance with U.S. Pat. No. 3,708,142, as compared to an exchanger constructed in accordance with the present invention, the present invention provides a better overall compromise when both the pressure drop and the heat transfer coefficient are considered. In addition, tube bundles supported in accordance with the present invention are somewhat cheaper to fabricate in some instances as compared to those of the earlier invention.

It is emphasized that the present invention is a very significant breakthrough in heat exchanger design because supporting a tube bundle in accordance with the present invention limits tube failure due to such things as vibration, improves the overall heat transfer coefficient as compared to prior art heat exchangers and at the same time reduces the pressure drop as compared to the plate type baffle heat exchangers well known in the art. Also, heat exchangers employing the inventive baffles and supporting apparatus are economically competitive with heat exchangers of the prior art and at the same time provide better overall performance.

An object of the invention is to support tubes of a tube bundle.

Another object of the invention is to lower the pressure drop on the shell side of a shell and tube heat exchanger and maintain a higher heat transfer coefficient as compared to heat exchangers known in the art.

Another object of the invention is to protect the tubes in a tube bundle from failure due to vibration.

Another object of the invention is to reduce the external fouling of tube bundles such as the fouling on the shell side of a shell and tube heat exchanger and the consequent loss of heat transfer capability.

Still another object of the invention is to provide a tube support to substantially reduce tube failure in a tube bundle and at the same time improve heat transfer coefficients and reduce the pressure drop on the shell side of a shell and tube heat exchanger.

Other objects, aspects and advantages of the invention will be apparent to those skilled in the art upon a study of the specification and drawings.

SUMMARY OF THE INVENTION

According to the invention a baffle comprises an outer ring suitable for surrounding a plurality of parallel tubes which form at least a first plurality of parallel tube rows and a second plurality of parallel tube rows and spaces between at least a portion of the adjacent tube rows, and a plurality of parallel rods cooperating with and attached to said outer ring to form a plurality of parallel chords with said outer ring wherein said rods are capable of passing in the spaces between the tubes forming adjacent parallel tube rows of one plurality of parallel tube rows and wherein the number of rods in the baffle is substantially less than the total number of rods which could be positioned in the spaces between the tube rows in the plurality of parallel tube rows.

Further according to the invention a supporting apparatus for a plurality of tubes in the form of a tube bundle wherein the tubes are positioned to form at least a first plurality of parallel tube rows and a second plurality of parallel tube rows and spaces between at least a portion of the adjacent tube rows comprises at least one baffle set providing radial support for each tube and comprising at least three baffles, wherein each baffle is as described above.

Further according to the invention a plurality of tubes is supported by arranging the tubes in the form of a tube bundle having at least a first plurality of parallel tube rows and a second plurality of parallel tube rows and having spaces between at least a portion of the adjacent tube rows, forming at least one baffle set comprises baffles wherein the number of baffles in each baffle set is sufficient to radially support each tube in the tube bundle, and forming each of said baffles by positioning an outer ring around the tube bundle and inserting a plurality of rods through a portion of the spaces between adjacent parallel tube rows of one plurality of parallel tube rows to cooperate with the outer ring to form a plurality of parallel chords wherein each such rod is of sufficient size to provide support for the tubes in the tube rows adjacent the rod and wherein the number of such rods inserted to form each baffle is substantially less than the total number of rods which could be positioned in the spaces between the tube rows of the plurality of parallel tube rows.

DETAILED DESCRIPTION OF THE PREFERRED EMBODIMENTS

Figure 1:
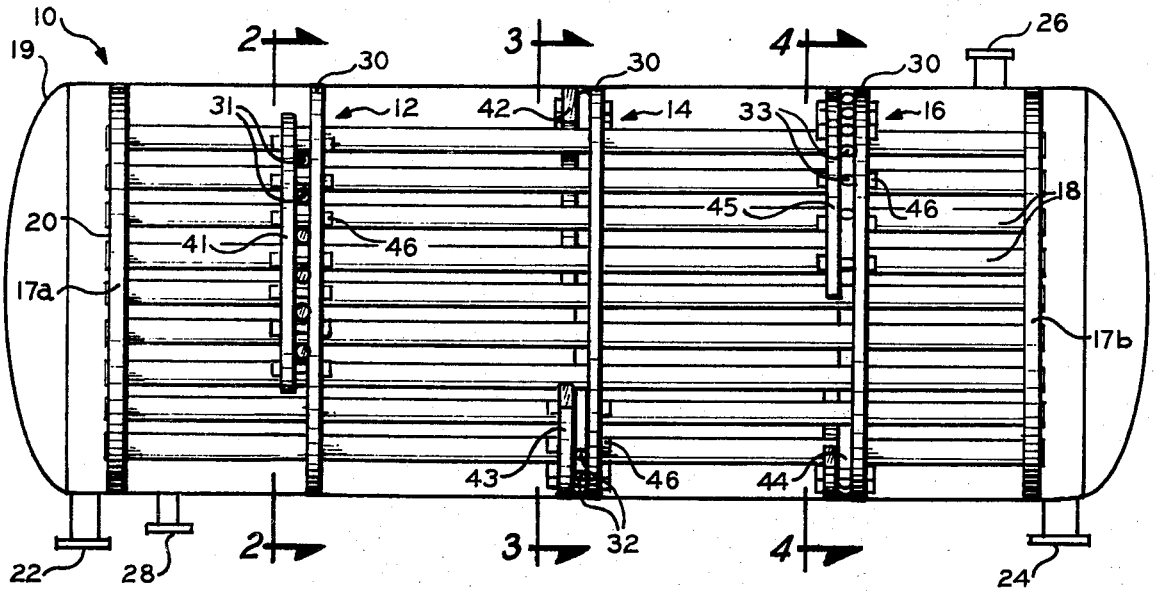
FIG. 1 is an elevational view of a heat exchanger employing an embodiment of the invention.

High flow rates of the fluids passed through a heat exchanger frequently cause vibration of the tubes in the tube bundle if the tubes are not radially supported which in turn causes one or more of the tubes to fail prematurely, that is, before the tube or tubes would be expected to fail based upon the materials used to construct the tubes and the service of the exchanger. Two of the common methods for reducing such vibration are the addition of plate baffles to add additional support to the tubes of the tube bundle and/or the lowering of the velocity of the fluid across the tubes. The addition of plate baffles causes a substantial increase in pressure drop through the shell side of the heat exchanger and reduction in the shell side flow rate requires a larger, more expensive exchanger than is otherwise necessary. The present invention solves the vibration problem without substantially increasing the shell side pressure drop or substantially reducing the shell side flow rate. As used herein the terms "pressure drop" and "pressure loss" are synonymous. It is noted that the heat exchanger and tube bundle designs shown in the drawings are schematic in nature and for purposes of better illustrating the invention. They are not intended as drawings showing the actual relative size of the exchanger and the component parts of the tube bundle.

Figure 2:
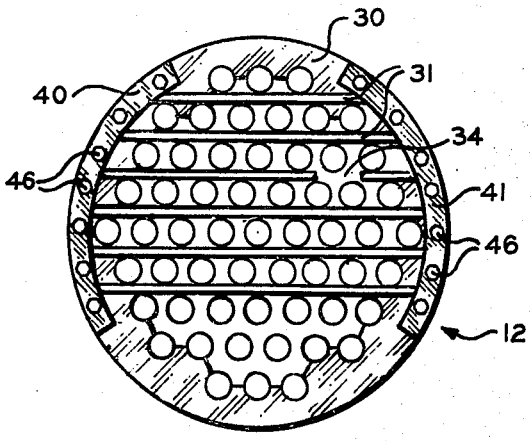
FIG. 2 is a cross-sectional view taken substantially on line 2—2 of FIG. 1 showing a baffle in accordance with the invention.
Figure 3:
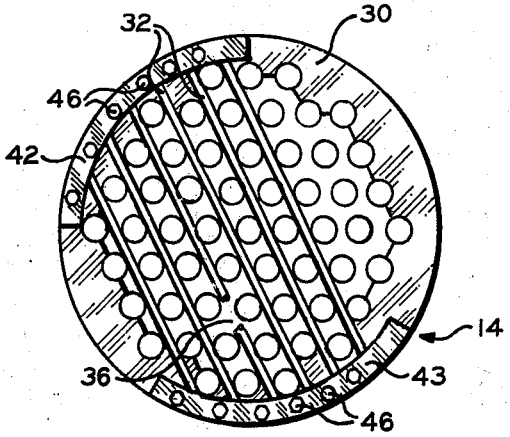
FIG. 3 is a cross-sectional view taken substantially on line 3—3 of FIG. 1 showing another baffle of the invention suitable for use in combination with that of FIG. 2.
Figure 4:
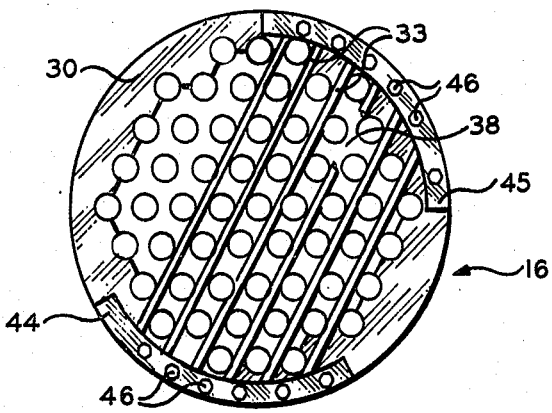
FIG. 4 is a cross-sectional view taken substantially on line 4—4 of FIG. 1 showing another baffle of the invention suitable for use with those of FIGS. 2 and 3.

Referring to FIG. 1, a heat exchanger, denoted generally by reference numeral 10, employing an embodiment of the invention has two tube sheets 17*a* and 17*b* and three baffles 12, 14 and 16 supporting the tubes 18 which are in the form of a tube bundle 20 positioned inside shell 19. Although each of baffles 12, 14 and 16 is shown lying in a plane which is perpendicular to the longitudinal axis of tube bundle 20, it is possible to use baffles which are not in a plane perpendicular to the longitudinal axis of tube bundle 20; however, baffles lying in the perpendicular plane as shown are easier and cheaper to construct and thus preferred. The tube side of heat exchanger 10 has an inlet nozzle 22 and an outlet nozzle 24 to permit a first fluid to pass over the inside surface of the tubes and the shell side has an inlet nozzle 26 and an outlet nozzle 28 to permit a second fluid to pass over the outside surface of the tubes when using countercurrent flow of the heat exchange mediums. The tubes 18 in heat exchanger 10 are laid out on an equilateral triangular pitch as shown clearly in the baffles of FIGS. 2 to 4 and form a first, second and third plurality of parallel tube rows oriented at 60 degrees to one another. Baffle 12 of FIG. 2 shows the first plurality of parallel tube rows which are positioned parallel to rods 31. Adjacent parallel tube rows form a space through which the rods are positioned. An example of the space formed by adjacent tube rows through which a rod is passed is indicated by reference numeral 34. Baffle 14 of FIG. 3 shows the second plurality of parallel tube rows which are positioned parallel to rods 31. An example of the space formed by adjacent tube rows through which a rod is passed is indicated by reference numeral 36. Baffle 16 of FIG. 4 shows the third plurality of parallel tube rows which are positioned parallel to rods 33. An example of the space formed by adjacent tube rows through which a rod is passed is indicated by reference numeral 38. Baffles 12, 14 and 16 constitute a baffle set because all three baffles are required before all the tubes in the tube bundle are radially supported. As used herein a tube is "radially supported" when the tube is restricted from movement in all directions perpendicular to the longitudinal axis of the tube.

Each baffle in FIGS. 2, 3 and 4 is made from an outer ring 30 surrounding the tubes 18 in the tube bundle 20. Rods 31 are positioned within the space between adjacent rows of tubes 34 of FIG. 2, rods 32 between adjacent rows of tubes 36 of FIG. 3, and rods 33 between adjacent rows of tubes 38 of FIG. 4 so as to cooperate with outer ring 30 to form a plurality of parallel chords with outer ring 30. Generally rods 31, 32 and 33 are affixed to outer ring 30, such as by welding them to the ring or bolting them to the ring using tie down members 40, 41 for baffle 12; 42, 43 for baffle 14 and 44, 45 for baffle 16 along with bolts 46. Rods 31, 32 and 33 must be of sufficient size to provide support for tubes 18 in the tube rows adjacent each rod. The total number of rods used in each baffle must be substantially less than the total number of rods which could be positioned in the spaces between the tube rows of the baffle.

Where only three baffles make up a baffle set, three baffles in a baffle set being the least number of baffles that can be used in accordance with the invention where the tubes are laid out on an equilateral triangular pitch, no more rods need be used in each baffle than the number which will provide radial support for each tube in the tube bundle. Generally an equal number of rods are used in each baffle; however, there may be instances where there is some variation in the number of rods used in the individual baffles of a set. At least one baffle set is required in accordance with the invention but baffles over and above those needed to constitute one baffle set can be used including partial baffle sets. For example, where three baffles are necessary for a baffle set, five baffles can be used in accordance with the invention, and if the baffles are equally spaced between the tube sheets, the longest unsupported tube distance is three times the distance between any two of the baffles.

Since one of the more important aspects of the invention is the reduction of tube failure due to vibration, the maximum unsupported tube distance is very important in designing a supporting apparatus. Since it is desirable to prevent tube collisions by adjacent tubes between support points, the supporting apparatus is generally designed so that the maximum allowable tube deflection under load is equal to something less than one-half the clearance between adjacent tubes.

Figure 5:
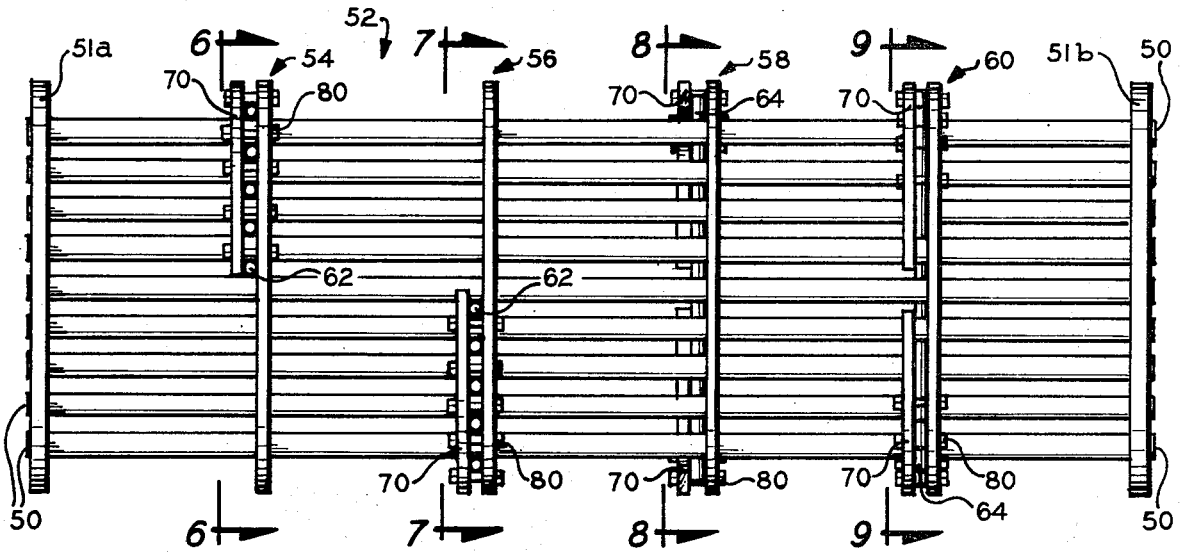
FIG. 5 is an elevational view of a plurality of tubes in the form of a tube bundle employing another embodiment of the invention.
Figure 6:
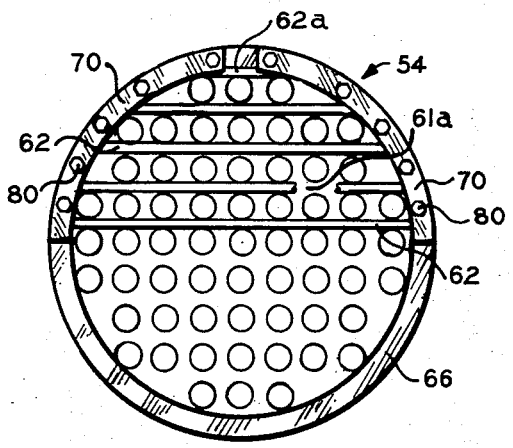
FIG. 6 is a cross-sectional view taken substantially on line 6—6 of FIG. 5 showing a baffle of the invention.
Figure 7:
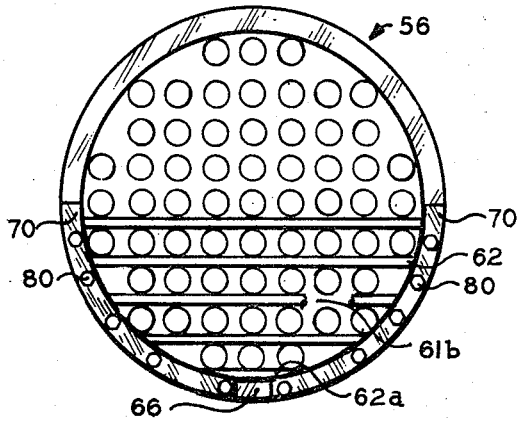
FIG. 7 is a cross-sectional view taken substantially on line 7—7 of FIG. 5 showing another baffle of the invention suitable for use with that of FIG. 6.
Figure 8:
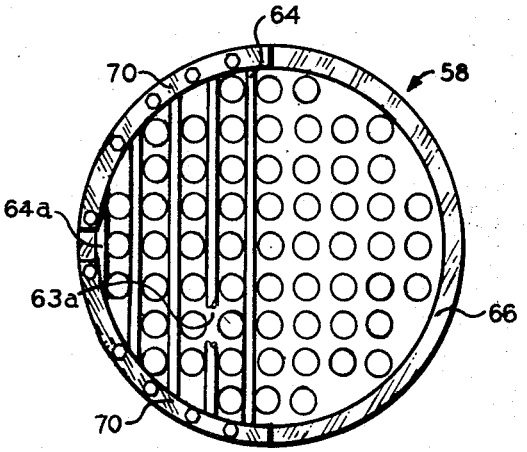
FIG. 8 is a sectional view taken substantially on line 8—8 of FIG. 5 showing another baffle of the invention suitable for use with those of FIGS. 6 and 7.
Figure 9:
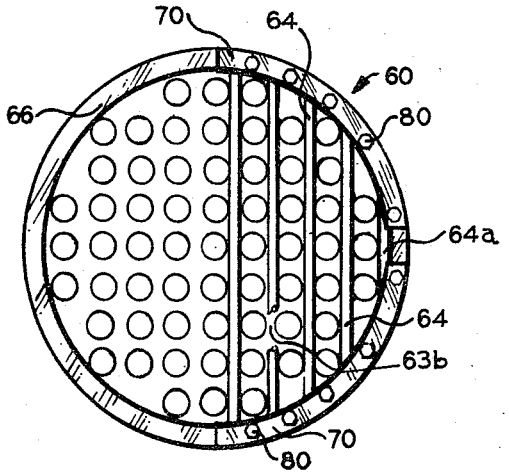
FIG. 9 is a cross-sectional view taken substantially on line 9—9 of FIG. 5 showing another baffle of the invention suitable for use with those of FIGS. 6, 7 and 8.
Figure 10:
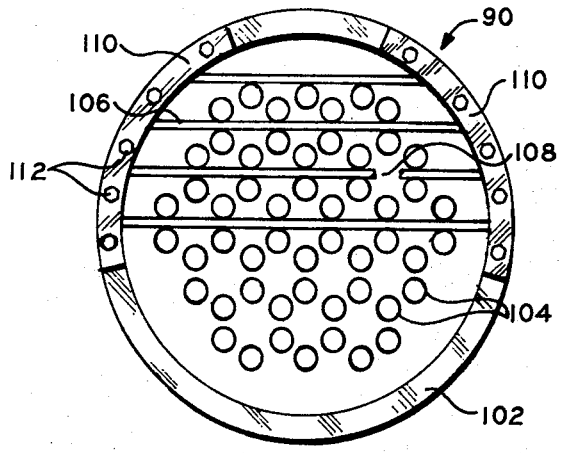
FIGS. 10 to 15 illustrate a baffle set in accordance with another embodiment of the invention comprising six baffles wherein the tubes in the tube bundle are laid out on a hexagonal pitch.
Figure 11:
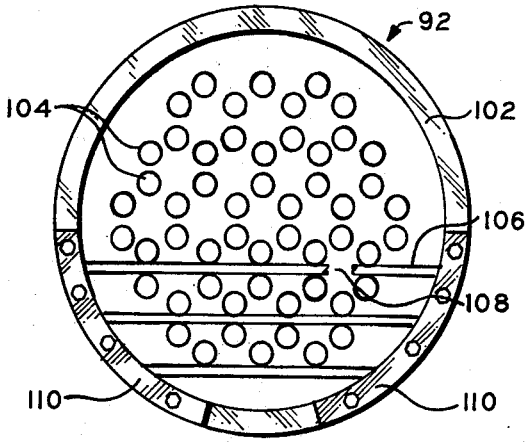
Figure 12:
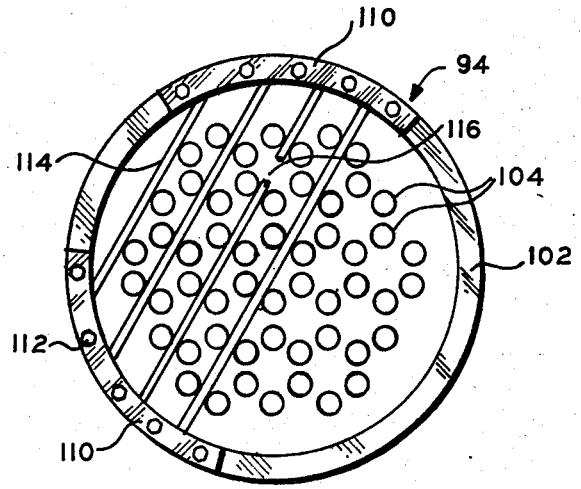
Figure 13:
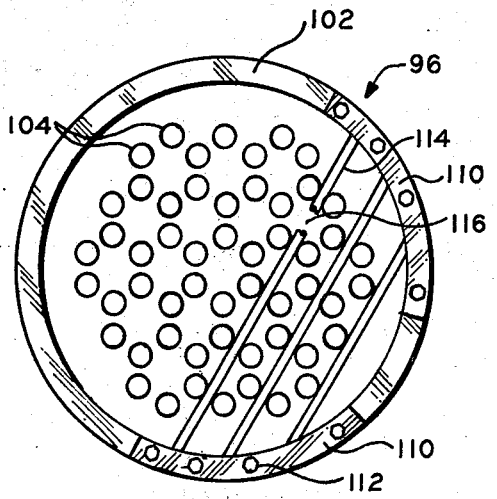
Figure 14:
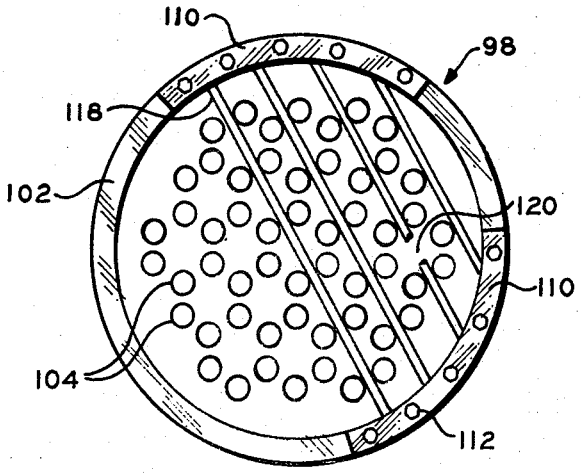
Figure 15:
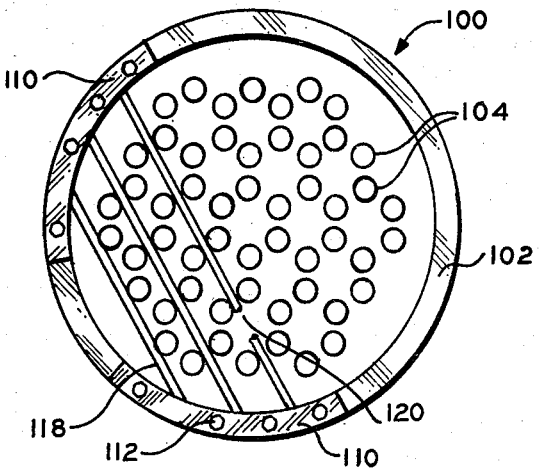

FIGS. 5 through 9 illustrates a preferred embodiment of the invention because the tubes 50 in tube bundle 52 having tube sheets 51*a* and 51*b* are laid out in square pitch and generally a square pitch tube layout provides greater surface area for a given shell diameter for an apparatus constructed in accordance with the invention. For example, there are 61 tubes in the embodiment of the invention shown in FIGS. 5 to 9 and only 57 tubes in the embodiment of the invention shown in FIGS. 1 to 4, and both embodiments are drawn to the same scale. The invention as illustrated in FIGS. 5 through 9 shows four baffles 54, 56, 58 and 60 and a supporting apparatus requiring all four baffles to constitute a baffle set. In FIGS. 6 and 7 there is a first plurality of parallel tube rows (the horizontal tube rows) and in FIGS. 8 and 9 there is a second plurality of parallel tube rows (the vertical tube rows). Rods 62 and 62*a* are positioned in the space between the tube rows in the upper half and the lower half of the horizontal tube rows of FIG. 6 and FIG. 7 respectively and cooperate with outer rings 66 to form a plurality of parallel chords with outer rings 66. An example of a space between adjacent tube rows is represented in FIG. 6 by reference numeral 61*a* and in FIG. 7 by reference numeral 61*b*. Rods 64 and 64*a* are also positioned in the space between the tube rows in the left half and the right half of the vertical tube rows of FIG. 8 and FIG. 9 respectively and cooperate with outer rings 66 to form a plurality of parallel chords with outer rings 66. An example of a space between adjacent tube rows is represented in FIG. 8 by reference numeral 63*a* and in FIG. 9 by reference numeral 63*b*. Rods 62, 62*a*, 64 and 64*a* are of sufficient size to provide support for the tubes in the tube rows adjacent each rod and the number of rods in each baffle is substantially less than the total number of rods which could be positioned in the spaces between the tube rows. The rods in the baffles shown in FIGS. 5 to 9 are held in position by tie down members 70 bolted to rings 66 using bolts 80.

In the embodiment of the invention as shown in FIGS. 5 to 9 the baffles are shown in the presently preferred embodiment wherein rings 66 are simply an annular shape as compared to rings 30 of FIGS. 1 to 4 in which the inside edge of rings 30 is cut to provide partial support for the tubes located adjacent the inside edge of the rings; however, it is difficult to make the circular cuts for partially supporting the tubes located adjacent the inside edge of the rings 30 so that no radial movement of the tubes is allowed. The design of baffles 54, 56, 58 and 60 of FIGS. 5 to 9 avoids this problem simply by not making the ring with such cuts and using one additional rod to support the tubes which would be otherwise partially supported by the cuts in the ring. The additional rod is shown as 62*a* in FIGS. 6 and 7 and as 64*a* in FIGS. 8 and 9. Further, the design of the baffles with annular rings 66 in FIGS. 5 to 9 is preferred because such a design further reduces the pressure loss through the heat exchanger since part of the ring which restricted the flow of the shell side fluid is eliminated. Therefore, this design simplifies the construction of the baffles and particularly rings 66, helps prevent premature tube failure due to the tubes rubbing against the relatively sharp inside edge of the rings, and further reduces the pressure loss across the shell side of the heat exchanger.

Figure 19:
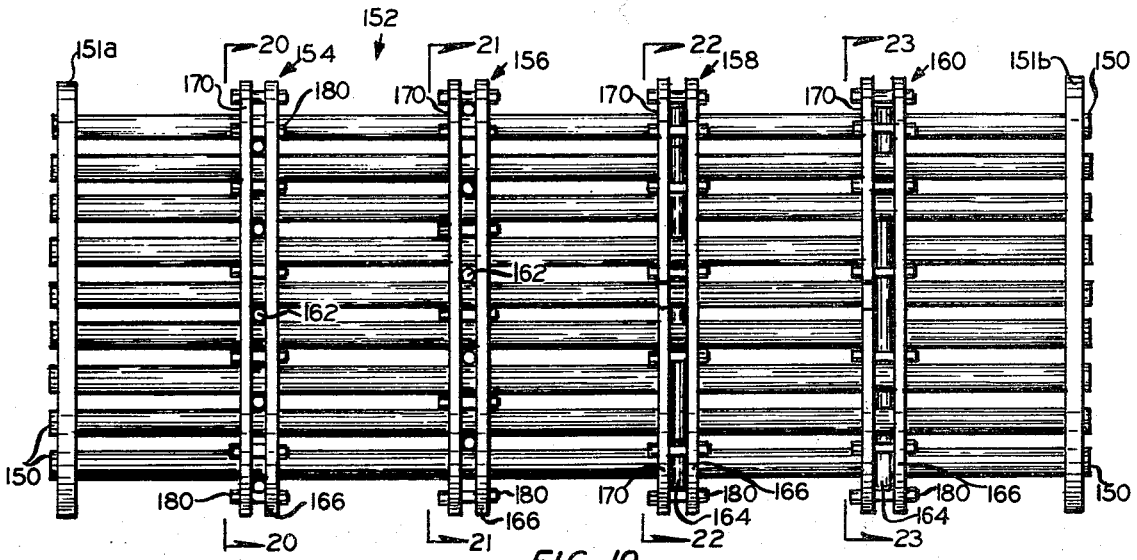
FIG. 19 is an elevational view of a plurality of tubes in the form of a tube bundle employing another embodiment of the invention.
Figure 20:
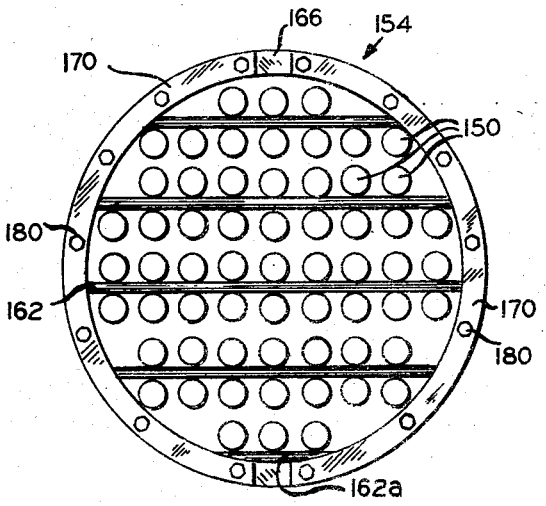
FIG. 20 is a cross-sectional view taken substantially on line 20—20 of FIG. 19 showing a baffle of the invention.
Figure 21:
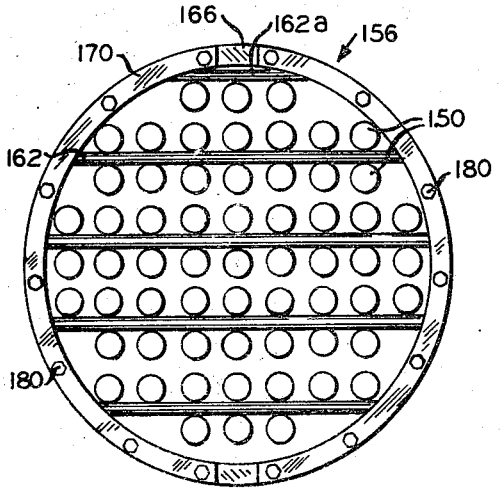
FIG. 21 is a cross-sectional view taken substantially on line 21—21 of FIG. 19 showing another baffle of the invention suitable for use with that of FIG. 20.
Figure 22:
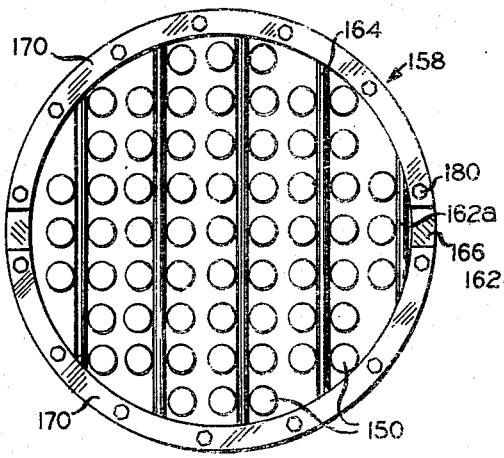
FIG. 22 is a cross-sectional view taken substantially on line 22—22 of FIG. 19 showing another baffle of the invention suitable for use with those of FIGS. 20 and 21.
Figure 23:
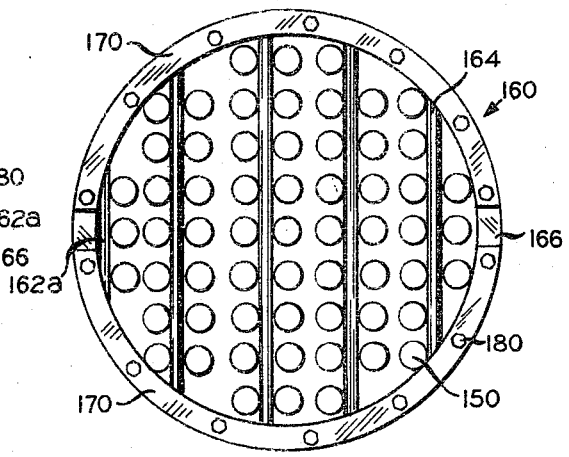
FIG. 23 is a cross-sectional view taken substantially on line 23—23 of FIG. 19 showing another baffle of the invention suitable for use with those of FIGS. 20, 21 and 22.

In the embodiment of the invention as shown in FIGS. 19 to 23 the baffles are very similar to those shown in FIGS. 5 to 9. In FIGS. 19 to 21 rods 162 are inserted in alternate spaces between adjacent tube rows in each baffle whereas rods 62 in FIGS. 5 to 7 are inserted in adjacent spaces between adjacent tube rows. In FIGS. 19, 22 and 23 rods 164 are inserted in alternate spaces between adjacent tube rows in each baffle as compared to FIGS. 5, 8 and 9 wherein rods 64 are inserted in adjacent spaces between adjacent tube rows. But in any of the embodiments of the invention the rods are only inserted in a portion of the spaces between adjacent tube rows. FIGS. 19 to 23 further illustrate rings 166 surrounding tubes 150 which form a tube bundle 152 with the rods passing through tube bundle 152 and attached to rings 166 employing tie down members 70 bolted to rings 166 using bolts 180.

The baffles in FIGS. 19 to 23 are constructed in the same manner as those shown in FIGS. 5 to 9 in that rings 166 of FIGS. 19 to 23 and rings 66 of FIGS. 5 to 9 are simply annular rings and not the same type of ring as rings 30 shown in FIGS. 1 to 4 which are cut with an inside edge to fit partially around the tubes to give partial support thereto. Since rings 166 are the annular rings, use of additional rods **162*a* in FIGS. 20 and 21 and additional rods 164*a* in FIGS. 22 and 23 are required. Rods 162*a* and 164*a* are required for the same reason as rods 62*a* and 64*a* in FIGS. 6 to 9 as previously described. Further the baffles in any embodiment of the invention can be positioned in a plane which is not perpendicular to the longitudinal axis of the tubes as well as in a plane which is perpendicular to said axis. It is presently preferred to construct the support apparatus of the invention using baffles which are positioned in a plane perpendicular to the longitudinal axis of the tubes because the rings 166** can be circular in shape as opposed to the more difficult to construct elliptical shape required for baffles positioned in a plane which is not perpendicular to the longitudinal axis of the tubes. Of course it is understood that baffles positioned in a plane perpendicular to the longitudinal axis of the tubes as well as baffles positioned in a plane not perpendicular to said axis are within the scope of the present invention.

It is emphasized that a supporting apparatus in accordance with the present invention only requires that the rods in each baffle inserted in the spaces between adjacent tube rows in one plurality of parallel tube rows are inserted into less than the total number of such spaces and further that when the rods are inserted into such spaces in the baffles that at least three baffles are required to radially support each and every tube in the tube bundle. It is immaterial whether the rods are inserted in adjacent spaces, alternate spaces, two adjacent spaces followed by skipping two spaces or any variation desired. The baffles shown in FIGS. 6 to 9 are essentially identical to the baffles shown in FIGS. 20 to 23 for all practical purposes.

The 6 baffles shown in FIGS. 10 to 15, illustrating another embodiment of the invention, are required to make a baffle set using the tube layout there shown. The baffle set provides radial support for each tube and only three rods are tangent to each tube. Three rods positioned around each tube are the minimum number required to provide radial support for each tube so long as the total spacing between the three rods is in excess of 180 degrees, which is the case in FIGS. 10 to 15.

In FIGS. 10 to 15 baffles 90, 92, 94, 96, 98 and 100 respectively are shown comprising rings 102 surrounding tubes 104 in the form of a tube bundle in which the tubes are laid out on a hexagonal pitch. Rings 102 are the same annular shape as rings 66 shown in FIGS. 5 to 9. In baffles 90 and 92, rods 106 are positioned in the space 108 between parallel tube rows in a first plurality of parallel tube rows. In baffles 94 and 96 rods 114 are positioned in spaces 116 between parallel tube rows of a second plurality of parallel tube rows. In baffles 98 and 100 rods 118 are positioned in spaces 120 between parallel tube rows of a third plurality of parallel tube rows. The rods of each baffle are held in place by tie down members 110 bolted in rings 102 using bolts 112.

The minimum number of rods in a baffle is the number sufficient for the baffle set to provide radial support for each tube forming the tube bundle. It is preferred that this functional limitation also be used to determine the maximum number of rods in a baffle because the pressure drop across the shell side of a shell and tube heat exchanger is the lowest when the least number of rods are used to form the baffles; however, it is essential to use enough rods in each baffle for the baffle set to provide radial support for each tube.

Where a baffle set consists of 4 baffles, the rods in each baffle will be positioned in roughly 50 to 60 percent of the spaces between adjacent tube rows in one plurality of parallel tube rows. If a baffle set consists of 8 baffles, then roughly 25 to 35 percent of the spaces will contain rods. If the tubes of the tube bundle are laid out on a square pitch, then a baffle set must contain at least 4 baffles or a baffle set can contain even numbers above 4, such as 6, 8, 10, 12 etc. If the tubes of the tube bundle are laid out on triangular pitch, then a baffle set must contain a minimum of 3 baffles; however multiples of 3 can be used to constitute a baffle set, such as 6, 9, etc., although it is also possible to use 4 baffles or an even number of baffles above 4 to constitute a baffle set. If the tubes are laid out on a hexagonal pitch as shown in FIGS. 10 to 15, then at least 6 baffles per baffle set are required to provide radial support for each tube in the tube bundle. The number of baffles constituting a baffle set as described above must not be confused with the total number of baffles used in the tube bundle as this latter number can be any number above the minimum number required in a baffle set and the total number of baffles in the tube bundle is otherwise independent of the number of baffles in a baffle set.

It is apparent from the above description of FIGS. 1 to 15 and FIGS. 19 to 23 that the minimum number of baffles per baffle set is dependent upon the tube layout. Three different tube layouts are shown in the drawings; however, other tube layouts are possible in which the minimum number of baffles in a baffle set may be other than those specifically discussed. But with any tube layout, at least three baffles per baffle set are required to practice the present invention and the specific tube layouts herein discussed are presented for the purposes of illustration and are not intended to limit the broad invention.

Figure 24:
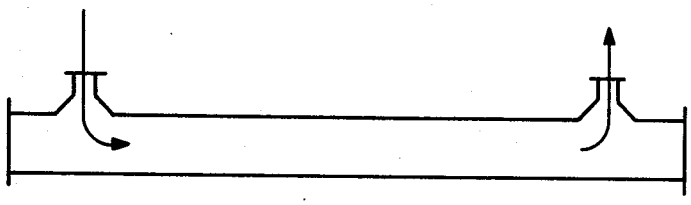
FIG. 24 is a schematic representation of a shell suitable for use in the invention having diverging inlet and outlet nozzles.
Figure 25:
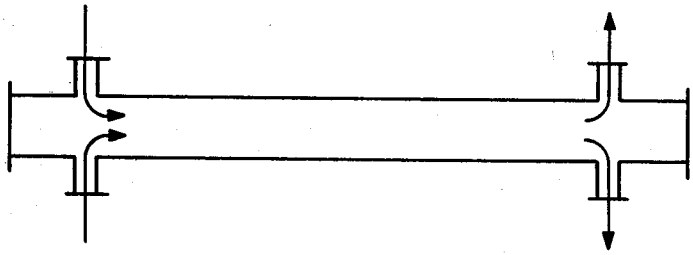
FIG. 25 is a schematic representation of a shell suitable for use in the invention having multiple inlet and outlet nozzles.

It is presently believed that the shell side pressure drop for any given exchanger designed in accordance with the invention will be largely localized at or near the inlet and outlet regions of the shell, and thus it is recommended to employ inlet and outlet shell side nozzle designs having low turbulence and pressure drop characteristics. For example, diverging nozzles as shown in FIG. 24, multiple nozzles as shown in FIG. 25 and annular distributors provide low pressure drop and low turbulence in the shell side inlet and outlet regions.

It is important in designing an apparatus in accordance with the invention to note that the fluid on the shell side of the apparatus flows essentially in the longitudinal direction, that is, essentially parallel to the longitudinal axis of the tubes; therefore it is recommended that longitudinal flow channels or passageways which are relatively large in relation to the clearance between the tube be minimized either by actual elimination of such passageways or blocking off such passageway using suitable baffles.

Inherent in the design of an apparatus shown in FIGS. 1 to 15 and FIGS. 19 to 23 is the incorporation of a ring baffle and a foundation for the rods forming the rod baffle. The ring baffle restricts the flow of the shell side fluid between the shell and the tube bundle and also provides a foundation to attach the rods in order to form the rod baffle.

It is appreciated by those skilled in the art that heat exchangers designed in accordance with the invention can be designed incorporating a variety of the configurations known in the art such as U-tubes, multiple tube passes, floating head designs, etc.

As mentioned previously it is preferred to position the outer rings and thus the baffles in a plane perpendicular to the longitudinal axis of the tube bundle because with the outer rings in such position it is generally easier to construct the baffles; however, baffles lying in a plane which is not perpendicular to the longitudinal axis of the tube bundle are within the scope of the invention.

In an effort to more fully describe the invention the following example is provided.

EXAMPLE

Figure 16:
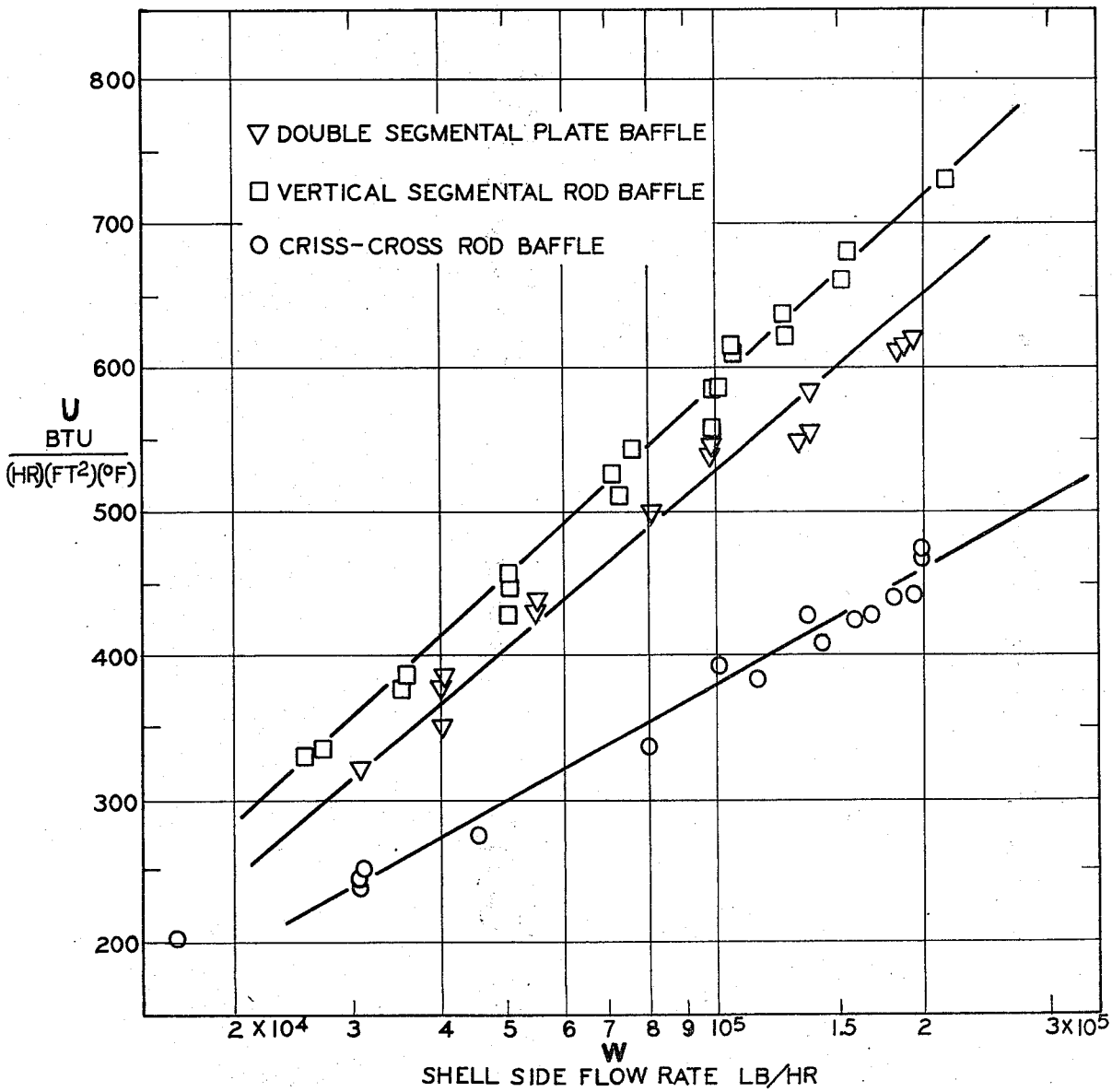
FIG. 16 graphically illustrates the overall heat transfer coefficient measured as a function of shell side flow rate for a heat exchanger made in accordance with applicant's invention and for two prior art heat exchangers.
Figure 17:
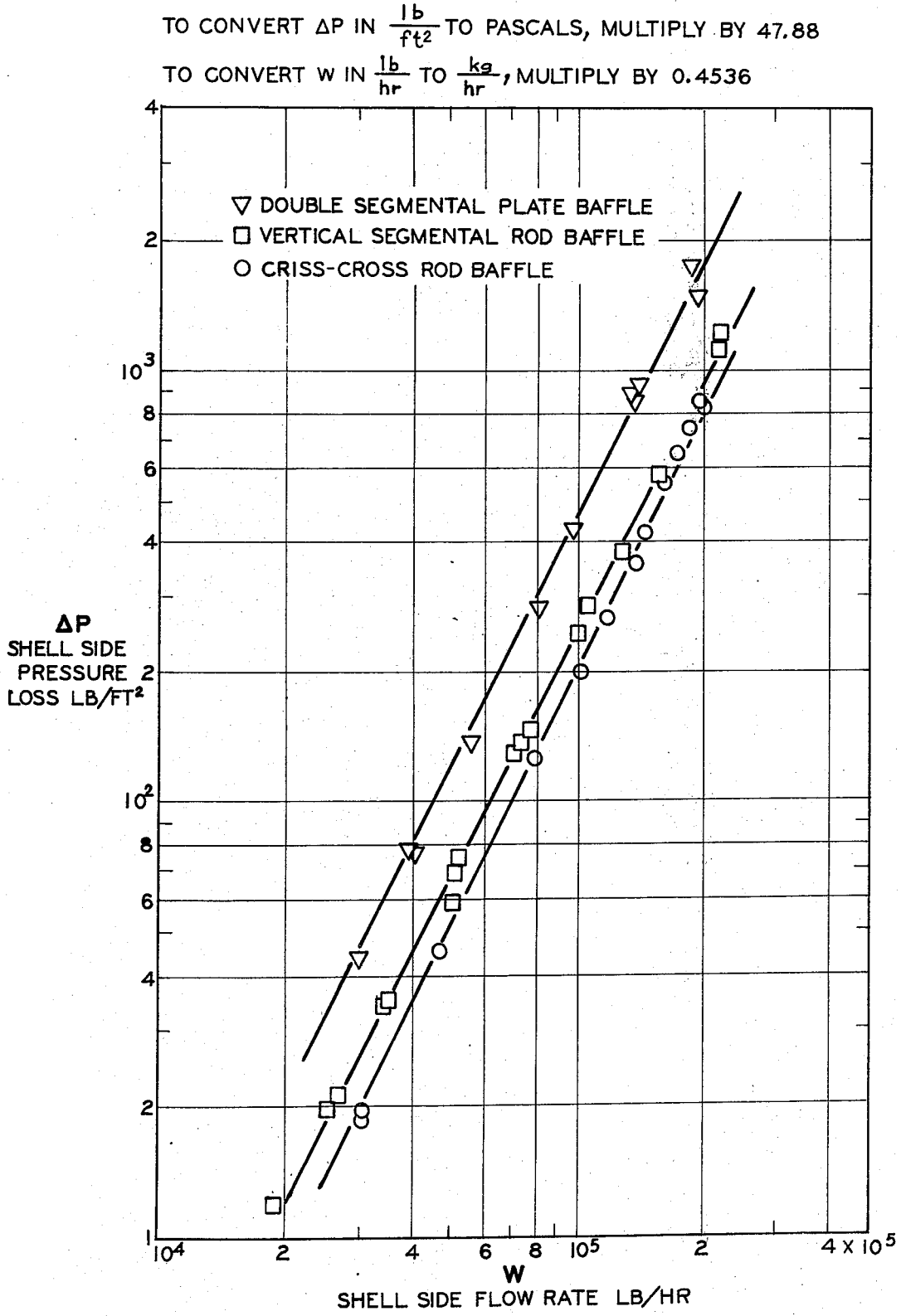
FIG. 17 is a graphical illustration of shell side pressure drop measured as a function of shell side flow rate employing the heat exchangers used for determining the values shown in the graph of FIG. 16.
Figure 18:
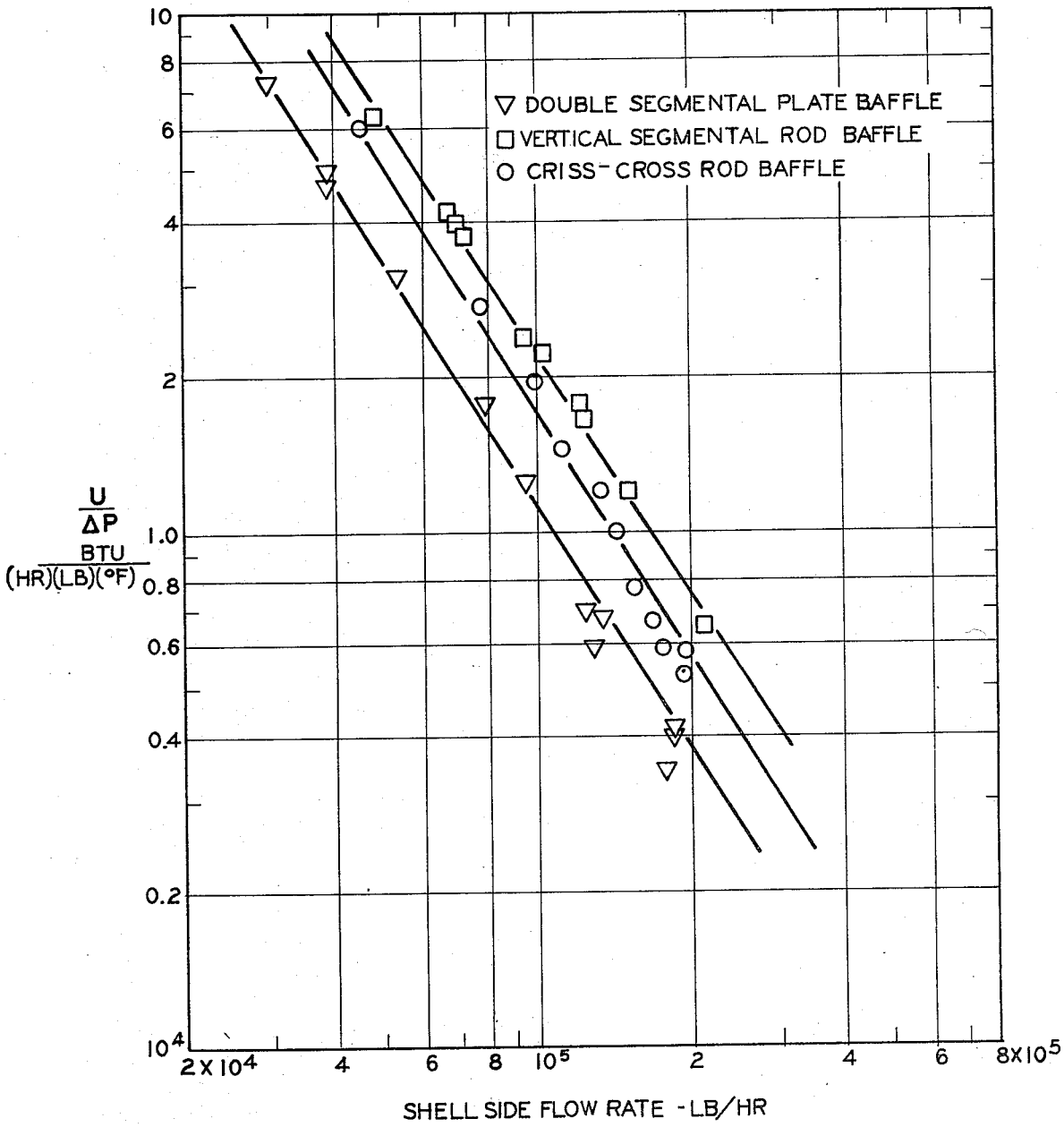
FIG. 18 illustrates graphically the ratio of the overall heat transfer coefficient to pressure drop measured as a function of shell side flow rate employing the same heat exchangers used for determining the values shown in the graphs of FIGS. 16 and 17.

Three countercurrent, single pass shell and tube heat exchangers were constructed and tested. Each heat exchanger contained 137 carbon steel tubes, 9.7 feet (2.96 m) long with a 0.5 inch (1.27 cm) outside diameter, laid out on a square pitch of 0.6875 inch (1.7463 cm) and having a shell inside diameter of 10.25 inches (26.04 cm). Each heat exchanger was designed to have the same tube support distance, 9.8 inches (24.89 cm). Both the shell side fluid and the tube side fluid were water with the tube flow rate equal to 4.2 feet per second (1.28 m/sec.), 115,800 pounds per hour. Hot fluid (shell side) inlet temperatures were generally about 165° F. (73.9° C.) with the cold fluid (tube side) inlet temperatures employed being appropriate values between 80° F. (26.7° C.) and 130° F. (54.4° C.). Thereby the temperature approach at each end of a tested exchanger was maintained greater than 10° F. to provide adequate heat exchange driving force, as known to those skilled in this art, from which consistent test results were calculated. The shell side flow rate, W, was varied from about 2500 to 20,000 pounds per hour (1134 to 9072 Kg/hr.). FIGS. 16, 17 and 18 graphically illustrate the results of the tests in which the overall heat transfer coefficient, U; pressure drop $\Delta P$; and the ratio $U/\Delta P$ were determined as functions of the shell side flow rate, W, by appropriate methods of calculation known to those skilled in this art from data taken during comparable test runs. Conversion factors are on each of the drawings for converting the data from English Units to the International System of Units.

One heat exchanger design employed was the double segmental plate baffle type referred to hereinafter as the segmental plate baffle heat exchanger. The baffle cut was 50 percent, that is, the baffle cut was such that it would provide an open area equal to substantially 50 percent of the total cross-sectional area of the shell less the space occupied by the tubes. This type of exchanger is frequently used and considered one of the standard designs in the industry. The tube support distance was 9.8 inches (24.89 cm); thus the baffle spacing was 4.9 inches (12.45 cm).

The second heat exchanger design employed was that described in U.S. Pat. No. 3,708,142, hereinafter referred to as the crisscross rod baffle heat exchanger. In this design each baffle provides radial support for each tube in the tube bundle; thus for a tube suppor distance of 9.8 inches (24.89 cm) a baffle spacing of 9.8 inches (24.89 cm) was used.

The third heat exchanger design was that of the present invention, referred to hereinafter as the vertical segmental rod baffle heat exchanger constructed in accordance with FIGS. 5 through 9 previously described except that the outer rings were constructed in accordance with the embodiment shown in FIGS. 2 to 4. Four baffles per baffle set were used with a baffle spacing of 2.4 inches to provide a tube support distance of 9.8 inches (24.89 cm), the same as used in the other two heat exchangers previously described. The number of rods used in each baffle was 24 which was the minimum number which provided radial support for each tube in the tube bundle. The rods in each baffle were positioned in approximately 50 percent of the spaces between adjacent tube rows in one plurality of parallel tube rows.

As shown in FIG. 16, the vertical segmental rod baffle heat exchanger provided a substantial and unexpected increase in the heat transfer coefficient over that of the other two heat exchangers. Throughout the entire range of flow rates employed the segmental rod baffle heat exchanger of the invention produced heat transfer coefficients ranging from approximately 11 to 14 percent higher than the double segmental plate baffle heat exchanger, and approximately 50 to 60 percent higher than the crisscross rod baffle heat exchanger.

FIG. 17 shows that the shell side pressure loss (in pounds per square foot) of the vertical segmental rod baffle heat exchanger was almost as low as that of the crisscross rod baffle heat exchanger and that the pressure drop for either of those two heat exchangers was substantially better than the pressure loss of the double segmental plate baffle heat exchanger. The pressure drop data for the vertical segmental rod baffle exchanger of the invention is particularly surprising since it was this heat exchanger that provided the best heat transfer coefficients. Heat exchangers employing the tube support apparatus of the present invention are not only capable of operating at a much lower pressure drop than that of a double segmental plate baffle exchanger of comparable size but the same time provide substantially higher heat transfer coefficients as compared to a comparable double segmental plate baffle heat exchanger or a comparable crisscross rod baffle heat exchanger.

FIG. 18 shows that the ratio of the heat transfer coefficient to the pressure loss for a given shell side flow rate is substantially higher for the vertical segmental rod baffle heat exchanger as compared to the prior art heat exchangers. This graph, combining the results of FIGS. 16 and 17, provides an overall picture of the excellent results obtained employing the tube support method and apparatus of the present invention because both the pressure drop and the heat transfer coefficient are taken into consideration at the same time.

These three graphs and especially FIG. 18 clearly establish that the present invention definitely provides unexpected results as compared to prior art heat exchangers including one in which the baffles were constructed with rods.

What is claimed is:

1. Supporting apparatus for a plurality of tubes in the form of a tube bundle suitable for use in a shell and tube heat exchanger, said tubes positioned to form at least a first plurality of parallel tube rows and a second plurality of parallel tube rows and spaces between at least a portion of the adjacent tube rows comprising:

at least one baffle set providing radial support for each tube and comprising at least three baffles, wherein each baffle comprises an outer ring surrounding said tube bundle; and a plurality of rods positioned in a portion of the spaces between adjacent tube rows in one plurality of parallel tube rows and cooperating with said outer ring to form a plurality of parallel chords with said outer ring, each said rod being of sufficient size to provide support for the tubes in the tube rows adjacent said rod, and the number of rods in each of said baffles being substantially less than the total number of rods necessary for positioning one rod in each of the spaces between all of the tube rows in the plurality of parallel tube rows and, wherein each of said baffles is positioned substantially parallel to the other baffles in the apparatus.

2. The apparatus of claim 1 wherein the tubes are laid out on a square pitch and each baffle set comprises at least four baffles.

3. The apparatus of claim 2 wherein the number of rods in a baffle is no more then the number sufficient for the baffle set to provide radial support for each tube in the tube bundle.

4. The apparatus of claim 1 wherein the rods of the plurality of rods of each baffle are positioned in alternate spaces between adjacent tube rows in one plurality of parallel tube rows.

5. The apparatus of claim 1 comprising a plurality of baffle sets.

6. The apparatus of claim 1 wherein each outer ring surrounding the tube bundle is positioned in a plane perpendicular to the longitudinal axis of said tube bundle.

7. The apparatus of claim 1 wherein each outer ring surrounding the tube bundle is positioned in a plane which forms an acute angle with a plane perpendicular to the longitudinal axis of said tube bundle.

8. The apparatus of claim 2 wherein the number of baffles in a baffle set is eight.

9. The apparatus of claim 1 wherein the tubes are laid out on a triangular pitch.

10. The apparatus of claim 9 wherein each baffle set comprises at least four baffles.

11. The apparatus of claim 10 wherein the number of rods in a baffle is no more than the number sufficient for the baffle set to provide radial support for each tube in the tube bundle.

12. The apparatus of claim 10 wherein the outer ring surrounding the tube bundle is positioned in a plane perpendicular to the longitudinal axis of said tube bundle.

13. The apparatus of claim 10 wherein each outer ring surrounding the tube bundle is positioned in a plane which forms an acute angle with a plane perpendicular to the longitudinal axis of said tube bundle.

14. The apparatus of claim 1 wherein the tubes are laid out on a hexagonal pitch and each baffle set comprises six baffles.

15. The apparatus of claim 1 wherein the tubes are laid out on a square pitch and each baffle set comprises four baffles, wherein each outer ring surrounding the tube bundle is positioned in a plane which is perpendicular to the longitudinal axis of said tube bundle, and wherein the rods of the plurality of rods of each baffle are positioned in alternate spaces between adjacent tube rows in one plurality of parallel tube rows.

16. The apparatus of claim 1 wherein the tubes are laid out on a square pitch and each baffle set comprises four baffles, wherein each outer ring surrounding the tube bundle is positioned in a plane which is perpendicular to the longitudinal axis of said tube bundle, and wherein the rods of the plurality of rods of each baffle are positioned in the adjacent spaces between adjacent tube rows in one plurality of parallel tube rows.

17. Apparatus comprising:

a plurality of tubes forming a tube bundle suitable for use in a shell and tube heat exchanger, said tubes positioned to form at least a first plurality of parallel tube rows and a second plurality of parallel tube rows and spaces between at least a portion of the adjacent tube rows:

means supporting the ends of said tube bundle; and means supporting the tubes in the tube bundle intermediate their ends, said intermediate supporting means comprising at least one baffle set, each baffle set providing radial support for each tube and comprising at least four baffles wherein each baffle comprises an outer ring surrounding said tube bundle and positioned in a plane perpendicular to the longitudinal axis of said tube bundle;

a plurality of rods positioned in a portion of the spaces between adjacent tube rows in one plurality of parallel tube rows, attached to said outer ring and forming a series of parallel chords with said outer ring, said rods of sufficient size to provide support for the tubes in the tube rows adjacent each rod, and the number of rods used in each of said baffles being substantially less than the total number of rods necessary for positioning one rod in each of the spaces between all of the tube rows in the plurality of parallel tube rows and, wherein each of said baffles is positioned substantially parallel to the other baffles in the apparatus.

18. The apparatus of claim 17 further comprising a shell surrounding said tube bundle isolating the outside surface of the tubes from the inside surface of the tubes, said shell having an inlet and an outlet for a first fluid to pass over the inside surface of the tubes and an inlet and an outlet for a second fluid to pass over the outside surface of the tubes.

19. The apparatus of claim 18 wherein the inlet and outlet for the second fluid to pass over the outside surface of the tubes are nozzles of a design which minimizes the pressure drop and turbulence at or near the inlet and outlet of the second fluid of the apparatus.

20. The apparatus of claim 19 wherein each outer ring surrounding the tube bundle is positioned in a plane perpendicular to the longitudinal axis of said tube bundle.

21. The apparatus of claim 19 wherein each outer ring surrounding the tube bundle is positioned in a plane which forms an acute angle with a plane perpendicular to the longitudinal axis of said tube bundle.

22. A supporting apparatus according to claim 1 wherein the rods used in each baffle have a circular cross section.

23. Apparatus according to claim 17 wherein the rods used in each baffle have a circular cross section.

* * * * *